US008083894B2

(12) United States Patent
Gruszczynski et al.

(10) Patent No.: US 8,083,894 B2
(45) Date of Patent: Dec. 27, 2011

(54) METHOD FOR MANUFACTURING A SECURITY PAPER

(75) Inventors: Uwe Gruszczynski, Konigstein (DE); Thomas Bodendieck, Dresden (DE)

(73) Assignee: Giesecke & Devrient GmbH, Munich (DE)

( * ) Notice: Subject to any disclaimer, the term of this patent is extended or adjusted under 35 U.S.C. 154(b) by 783 days.

(21) Appl. No.: 11/995,227

(22) PCT Filed: Jul. 3, 2006

(86) PCT No.: PCT/EP2006/006437

§ 371 (c)(1),
(2), (4) Date: Jan. 10, 2008

(87) PCT Pub. No.: WO2007/006445

PCT Pub. Date: Jan. 18, 2007

(65) Prior Publication Data

US 2009/0236061 A1 Sep. 24, 2009

(30) Foreign Application Priority Data

Jul. 12, 2005 (DE) ..... 10 2005 032 815

(51) Int. Cl.

| | |
|---|---|
| ***D21F 11/00*** | (2006.01) |
| ***D21F 11/06*** | (2006.01) |
| ***D21F 1/44*** | (2006.01) |
| ***D21H 21/40*** | (2006.01) |

(52) U.S. Cl. ..... 162/140; 162/103; 162/109; 162/110

(58) Field of Classification Search ..... 162/103–104, 162/109, 114, 116, 123–124, 140; 283/67, 283/70, 72, 901

See application file for complete search history.

(56) References Cited

U.S. PATENT DOCUMENTS

| | | | | |
|---|---|---|---|---|
| 4,162,936 | A | 7/1979 | Frezzotti | |
| 4,523,777 | A | 6/1985 | Holbein et al. | |
| 4,740,269 | A | 4/1988 | Berger et al. | |
| 4,943,093 | A * | 7/1990 | Melling et al. | 283/83 |
| 5,093,184 | A | 3/1992 | Edwards | |
| 5,388,862 | A * | 2/1995 | Edwards | 283/82 |
| 5,393,099 | A | 2/1995 | D'Amato | |
| 5,405,500 | A * | 4/1995 | Knight | 162/103 |
| 5,783,275 | A | 7/1998 | Mück et al. | |

(Continued)

FOREIGN PATENT DOCUMENTS

CA 2294755 1/1999

(Continued)

OTHER PUBLICATIONS

International Search Report, International Application No. PCT/EP2006/004113, 6 pages, Feb. 23, 2007.

(Continued)

*Primary Examiner* — Jose A Fortuna
(74) *Attorney, Agent, or Firm* — Greenlee Sullivan P.C.

(57) ABSTRACT

The present invention relates to a method for manufacturing a security paper, for security or value documents, that exhibits at least one through opening (12) having characteristic irregularities (14) in the edge region. According to the present invention, a paper web having thin sites in the form of the outline of the desired shape of the at least one through opening (12) is formed on a paper mold, and the paper web dewatered after sheet formation, the region delimited by the thin sites being removed from the paper web by the occurring forces.

18 Claims, 2 Drawing Sheets

U.S. PATENT DOCUMENTS

Figure 1:
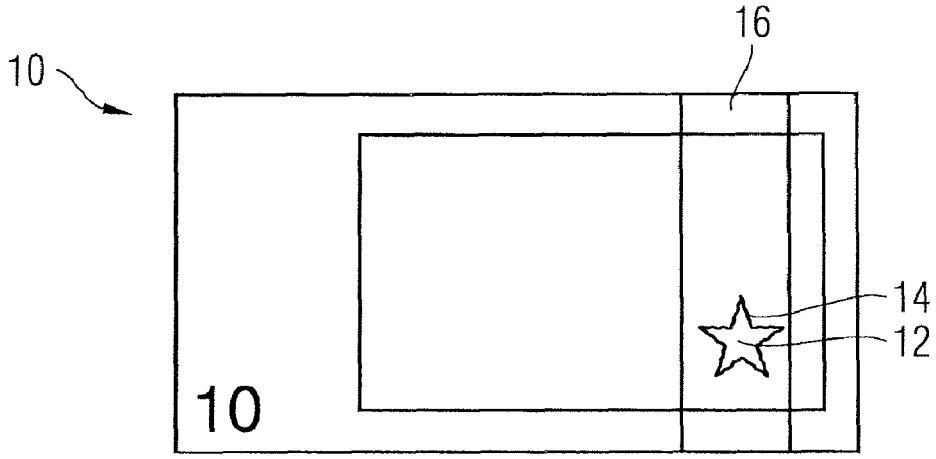

| | | | | |
|---|---|---|---|---|
| 5,961,432 | A * | 10/1999 | Murakami et al. | 493/187 |
| 6,036,230 | A | 3/2000 | Färber | |
| 6,402,888 | B1 | 6/2002 | Doublet et al. | |
| 6,607,813 | B2 | 8/2003 | Washburn et al. | |
| 6,616,803 | B1 * | 9/2003 | Isherwood et al. | 162/103 |
| 7,347,917 | B2 * | 3/2008 | Ash et al. | 162/140 |
| 7,632,380 | B2 * | 12/2009 | Doublet | 162/140 |
| 2004/0239097 | A1 | 12/2004 | Boehm et al. | |
| 2004/0249754 | A1 | 12/2004 | Kaule et al. | |
| 2005/0016702 | A1 * | 1/2005 | Ash et al. | 162/140 |
| 2005/0104364 | A1 * | 5/2005 | Keller et al. | 283/72 |
| 2005/0173084 | A1 * | 8/2005 | Doublet | 162/109 |
| 2005/0179254 | A1 * | 8/2005 | Heim et al. | 283/83 |
| 2005/0211403 | A1 * | 9/2005 | Hard | 162/140 |
| 2005/0224203 | A1 * | 10/2005 | Boehm et al. | 162/140 |
| 2006/0145468 | A1 | 7/2006 | Plaschka et al. | |
| 2006/0249042 | A1 * | 11/2006 | Heim et al. | 101/483 |
| 2006/0262367 | A1 * | 11/2006 | Hattori et al. | 359/15 |
| 2007/0165182 | A1 | 7/2007 | Hoffmuller | |
| 2007/0211238 | A1 | 9/2007 | Hoffmuller | |
| 2007/0216518 | A1 | 9/2007 | Hoffmuller | |
| 2007/0229928 | A1 | 10/2007 | Hoffmuller | |
| 2007/0241553 | A1 | 10/2007 | Heim | |
| 2007/0246933 | A1 | 10/2007 | Heim | |
| 2007/0274559 | A1 | 11/2007 | Depta | |
| 2008/0014378 | A1 | 1/2008 | Hoffmuller | |
| 2008/0054621 | A1 | 3/2008 | Burchard | |
| 2008/0079257 | A1 | 4/2008 | Fessl | |
| 2008/0088859 | A1 | 4/2008 | Depta | |
| 2008/0160226 | A1 | 7/2008 | Kaule | |
| 2008/0163994 | A1 | 7/2008 | Hoppe | |
| 2008/0179026 | A1 * | 7/2008 | Evangelisti | 162/140 |
| 2008/0198468 | A1 | 8/2008 | Kaule | |
| 2008/0216976 | A1 | 9/2008 | Ruck | |
| 2008/0250954 | A1 | 10/2008 | Depta | |
| 2008/0251222 | A1 * | 10/2008 | Krietsch et al. | 162/110 |
| 2008/0258456 | A1 | 10/2008 | Rahm | |
| 2009/0001709 | A1 | 1/2009 | Kretschmar | |
| 2009/0008923 | A1 | 1/2009 | Kaule | |
| 2009/0186205 | A1 * | 7/2009 | Doublet et al. | 428/215 |
| 2009/0322071 | A1 * | 12/2009 | Dichtl | 283/70 |
| 2010/0164217 | A1 * | 7/2010 | Gregarek et al. | 283/74 |
| 2010/0175843 | A1 * | 7/2010 | Gregarek | 162/140 |
| 2010/0207377 | A1 * | 8/2010 | Camus et al. | 283/72 |

FOREIGN PATENT DOCUMENTS

| | | | |
|---|---|---|---|
| DE | 2756591 | | 6/1978 |
| DE | 3048733 | | 7/1982 |
| DE | 3634098 | | 4/1987 |
| EP | 0059056 | | 9/1982 |
| EP | 0070172 | | 1/1983 |
| EP | 0229645 | | 7/1987 |
| EP | 0367520 | | 5/1990 |
| EP | 0400902 | | 12/1990 |
| EP | 0609252 | | 8/1994 |
| EP | 0690939 | | 9/1994 |
| EP | 0625431 | | 11/1994 |
| EP | 0687324 | | 12/1995 |
| EP | 0723501 | | 7/1996 |
| EP | 0860298 | | 8/1998 |
| EP | 1114 893 | | 7/2001 |
| GB | 1604463 | | 12/1981 |
| GB | 2213098 | A * | 8/1989 |
| GB | 2381539 | | 5/2003 |
| GB | 2388377 | | 11/2003 |
| GB | 2390056 | | 12/2003 |
| NL | 1006151 | C | 12/1998 |
| WO | WO 94/01291 | | 1/1994 |
| WO | WO 95/09274 | | 4/1995 |
| WO | WO 95/10419 | | 4/1995 |
| WO | WO 95/10420 | | 4/1995 |
| WO | WO 97/18092 | | 5/1997 |
| WO | WO 98/03348 | | 1/1998 |
| WO | WO 99/01291 | | 1/1999 |
| WO | WO 00/39391 | | 7/2000 |
| WO | WO 00/43216 | | 7/2000 |
| WO | WO 00/73583 | | 12/2000 |
| WO | WO 03/025281 | | 3/2003 |
| WO | WO 03/029003 | | 4/2003 |
| WO | WO 03/053713 | | 7/2003 |
| WO | WO 03/054297 | | 7/2003 |
| WO | WO 03/055683 | | 7/2003 |
| WO | WO 03/068496 | | 8/2003 |
| WO | WO 03/085193 | | 10/2003 |
| WO | WO 2004/009371 | | 1/2004 |
| WO | WO 2005/025891 | | 3/2005 |
| WO | WO 2005052249 | A1 * | 6/2005 |
| WO | WO 2005105473 | | 11/2005 |
| WO | WO 2005105474 | | 11/2005 |
| WO | WO 2005105475 | | 11/2005 |
| WO | WO 2005108106 | | 11/2005 |
| WO | WO 2005108108 | | 11/2005 |
| WO | WO 2005108110 | | 11/2005 |
| WO | WO 2006005434 | | 1/2006 |
| WO | WO 2006015733 | | 2/2006 |
| WO | WO 2006018171 | | 2/2006 |
| WO | WO 2006018172 | | 2/2006 |
| WO | WO 2006040069 | | 4/2006 |
| WO | WO 2006056342 | | 6/2006 |
| WO | WO 2006072380 | | 7/2006 |
| WO | WO 2006087138 | | 8/2006 |
| WO | WO 2006099971 | | 9/2006 |
| WO | WO 2006119896 | | 11/2006 |
| WO | WO 2006128607 | | 12/2006 |
| WO | WO 2007006445 | | 1/2007 |
| WO | WO 2007006455 | | 1/2007 |
| WO | WO 2007042131 | A1 * | 4/2007 |
| WO | WO 2007076952 | | 7/2007 |
| WO | WO 2007079851 | | 7/2007 |
| WO | WO 2007115648 | | 10/2007 |

OTHER PUBLICATIONS

International Search Report, International Application No. PCT/EP2006/006437, 3 pages, Feb. 23, 2007.

Database WPI, Section Ch, Week 199910, Derwent Publications Ltd., London, AN 1999-119157, Dec. 1, 1998, English Abstract for NL1006151C by Rudico Holding BV.

International Preliminary Report on Patentability, International Application No. PCT/EP2006/006437, 5 pages, Jun. 12, 2007.

Written Opinion, International Application No. PCT/EP2006/006437, 8 pages, Jan. 12, 2008.

English Translation of International Preliminary Report on Patentability, International Application No. PCT/EP2006/006437, 6 pages, May 15, 2008.

* cited by examiner

METHOD FOR MANUFACTURING A SECURITY PAPER

CROSS-REFERENCE TO RELATED APPLICATIONS

This application is the U.S. National Stage of International Application No. PCT/EP2006/006437, filed Jul. 3, 2006, which claims the benefit of German Patent Application DE 10 2005 032 815.6, filed Jul. 12, 2005, all of which are hereby incorporated by reference to the extent not inconsistent with the disclosure herewith.

The present invention relates to a method for manufacturing a security paper, for security or value documents, that exhibits at least one through opening having characteristic irregularities in the edge region. The present invention further relates to a paper mold for manufacturing such a security paper and a forming element for use in such a paper mold.

For protection, security papers or value documents are often equipped with various authenticity features that permit the authenticity of the security paper or value document to be verified, and that simultaneously serve as protection against unauthorized reproduction.

Within the meaning of the present invention, the term "security paper" refers to the unprinted paper that is typically present in quasi-endless form and is further processed at a later time. The term "value document" refers to a document that is finished for its intended use. For the purposes of the present invention, value documents are especially banknotes, stocks, bonds, certificates, vouchers, checks, valuable admission tickets and other papers that are at risk of counterfeiting, such as passports and other identification documents, as well as product protection elements, such as labels, seals, packaging and the like. In the following, the simplified designation "security paper" or "value document" includes all such documents and product protection means.

Publication WO 95/10420 describes a value document in which, after its manufacture, a through opening is punched that is subsequently closed on one side with a cover foil that overlaps the opening all around. The cover foil is transparent at least in a fractional region such that, when an attempt is made to copy the value document, the background shows through and is rendered by the copier accordingly. In this way, counterfeits can be easily recognized. However, the opening produced by punching can likewise be produced by a counterfeiter. Although the color copy of a genuine value document no longer exhibits the transparent region, similar to the genuine value document, this region can be subsequently punched out and again closed with a suitable cover foil. Such counterfeits are difficult to recognize.

To remedy this, it is recommended in publication WO 03/054297 to produce a through opening already during paper manufacture. Such an opening produced at sheet formation exhibits, in the edge region, characteristic irregularities that are not subsequently manufacturable in the finished paper. The irregularities reveal themselves especially through the lack of a sharp cut edge or through irregular accretion of fibers in the edge region and through individual fibers that protrude into the opening. Openings produced in this way have a similarly high security value as a watermark produced at paper manufacture or a security thread embedded at paper manufacture.

However, such openings produced at paper manufacture often vary in their quality and are not easy to manufacture reproducibly. To some extent there is also the danger that fiber bundles partially close the opening.

Based on that, the object of the present invention is to create a generic method that avoids the disadvantages of the background art. In particular, the method is intended to combine the high counterfeit security of the openings produced at paper manufacture with high reproducibility at manufacture.

This object is solved by the features of the independent claims. Developments of the present invention are the subject of the dependent claims.

According to the present invention, in a method of the kind cited above, on a paper mold, a paper web is formed having thin sites in the form of the outline of the desired shape of the at least one through opening, and after sheet formation, the paper web is dewatered, the region delimited by the thin sites being separated from the paper web by the occurring forces.

The present invention is based on the idea of producing the irregularly edged opening, not by a complete displacement of the fiber stock already at sheet formation, but rather, at sheet formation, first creating only the outline of the desired shape of the opening in the form of thin sites in the paper web. In these regions, the paper web then exhibits only a low initial strength such that, with the thin sites, there are introduced into the paper web predetermined breaking points by means of which the enclosed region can be separated from the still wet paper web in the subsequent dewatering step.

Compared with traditional methods, in which the desired openings are produced by contiguous displacement of the fiber stock, the method now proposed exhibits a lower susceptibility to variations at sheet formation and to changes in the opening form due to the flexibility of the still wet fiber stock such that the desired openings can be introduced very controlledly and reproducibly. With the aid of this method, in particular, irregularly edged openings having complex outline forms can be produced.

In a preferred embodiment of the method according to the present invention, the paper web is formed on a paper mold having applied line-shaped forming elements that, during sheet formation, lead to the development of the thin sites in the paper web. Here, the line-shaped forming elements preferably form a substantially closed curve. Here, "substantially closed" means that the curve formed by the forming elements can be completely closed, or can also include individual curve sections having small intermediate dividers lying therebetween, through which the removal of the region surrounded by the curve sections is not impeded. Likewise, also individual curve sections can remain completely fiber-free, the region surrounded by the thin sites and fiber-free regions still being connected to the wet paper web and, according to the present invention, separated from the paper web in the dewatering step.

The forming elements are advantageously formed by line-shaped metal or plastic forming parts applied to the paper mold. The forming parts can, for example, be soldered, welded or glued to the paper mold.

In another, likewise preferred variant, the forming elements are formed by a line-shaped sealing compound that is firmly bonded with the paper mold. Especially substances that allow application to the paper mold in the viscous state and that bond firmly with the paper mold after an active or passive curing process lend themselves as the sealing compound.

For example, the sealing compound can be formed by an epoxy-resin-based adhesive, a thermally cured soldering paste or a UV-cured adhesive. In an advantageous embodiment, a UV-curing adhesive is first applied to a large area of the paper fabric and then, via a mask, impinged on with UV radiation and cured in desired regions. The non-cured portion of the adhesive is washed out such that a forming element composed of UV-cured sealing compound having the desired form is created. Further advantageous embodiments and details are described in publication WO 03/025281, whose disclosure in this respect is incorporated in the present application.

To ensure a secure and reproducible removal of the surrounded region, the line-shaped forming elements preferably exhibit a line width between 0.3 mm and 5 mm, particularly preferably between 0.5 mm and 3 mm. The height of the line-shaped forming elements lies preferably between 0.5 mm and 2 mm, and especially between 0.8 mm and 1.5 mm. It is understood that the optimum values for the line width and height can be determined through comparative experiments depending on the desired irregularity of the edge curve, the size of the motif or the properties of the paper pulp.

According to an advantageous embodiment, the line-shaped forming elements, and thus the opening produced, form a shape having a complex outline, especially a graphic motif, such as a flower or leaf motif, or a more complicated geometric form, such as a multi-pointed star.

The paper mold is particularly advantageously a paper mold for a cylinder mold machine.

The thin sites are produced at sheet formation, preferably having only a few fibers lying on top of each other. This ensures, upon removal of the paper web from the mold, that on the one hand, the forms produced cannot shift, but on the other hand, that the strength of the thin sites is extraordinarily low such that, in the subsequent dewatering step, they act as predetermined breaking points.

The at least one opening is expediently closed on at least one side of the security paper with a foil element. In some designs, the opening is even closed on both sides with a foil.

Even if it was described above for a paper substrate, the method according to the present invention is suitable for all substrates having aqueous sheet formation from natural or synthetic fibrous materials, such as cotton combings, pulps, fibers from organic or inorganic plastics, and their blends.

Further exemplary embodiments and advantages of the present invention are explained below by reference to the drawings, in which a depiction to scale and proportion was omitted in order to improve their clarity.

Figure 2:
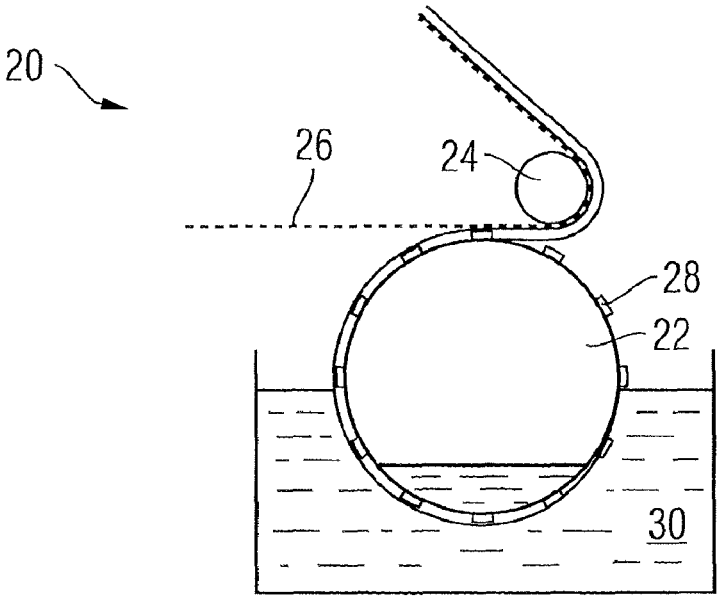
Figure 3:
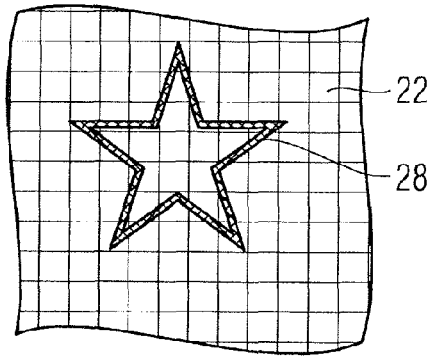
Figure 4:
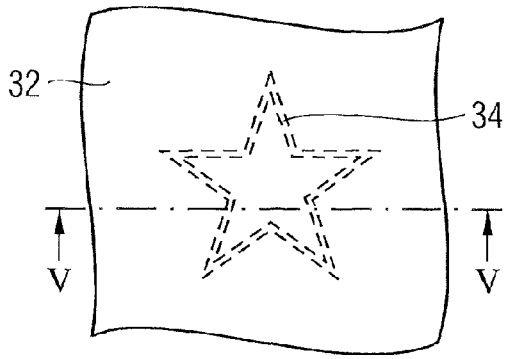
Figure 5:
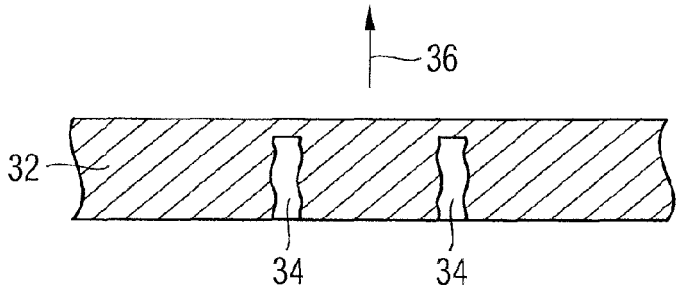
Figure 6:
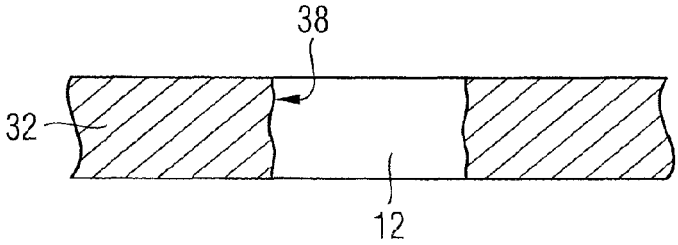

Shown are:

FIG. 1 a schematic diagram of a banknote composed of a security paper according to an exemplary embodiment of the present invention, FIG. 2 a portion of a paper machine for manufacturing a security paper according to the present invention, FIG. 3 a top view of a section of the paper mold of the paper machine in FIG. 2 having a metal forming part that is soldered on, FIG. 4 a top view of the paper web that is lifted off the paper mold and, with the aid of the metal forming part in FIG. 3, provided with thin sites, FIG. 5 a cross section through the paper web in FIG. 4 along the line V-V, and FIG. 6 a cross section through the paper web in FIG. 5 after the removal of the region delimited by the thin sites.

The invention will now be explained using a security paper for a banknote as an example. For this, FIG. 1 shows a schematic diagram of a banknote 10 having a through opening 12 that is closed by a transparent foil strip 16. Here, the through opening 12 was produced during the manufacture of the security paper used for the banknote 10 and exhibits a fibrous, irregular edge region 14. Such an edge 14 is characteristic for openings manufactured already at sheet formation and cannot be produced subsequently by punching or cutting the paper.

According to the present invention, the following procedure is used to be able to reproducibly manufacture such openings 12 having more complex outline forms, such as the star motif shown in FIG. 1.

FIG. 2 first shows a portion of a cylinder mold paper machine 20, as used for manufacturing security papers. FIG. 3 shows a top view of a section of the cylinder mold 22 of the paper machine 20. The cylinder mold paper machine 20 comprises, in addition to the cylinder mold 22, a pick-up roll 24, over which a pick-up felt 26 is stretched. To produce the openings 12, to the cylinder mold 22 are soldered line-shaped metal forming parts 28 that form a closed curve in the form of the outline of the opening to be produced, for example of the star motif 12 in FIG. 1.

When the cylinder mold 22 is immersed in the paper pulp 30, sheet formation is hindered locally in the region of the metal forming parts 28. In this way, as is perceptible in the top view of the produced paper web 32 in FIG. 4 and the cross section in FIG. 5, thin sites 34 in the shape of the metal forming parts 28 and thus in shape of the desired outline are produced in the paper web 32.

Here, the height of the line-shaped metal forming parts 28 is chosen such that, in the region of the thin sites 34, after sheet formation, only a few fibers lie on top of each other, but no through hole is produced in the paper web. Thus, in the region of the thin sites 34, the paper web has only a low initial strength such that the thin sites 34 constitute predetermined breaking points. On the other hand, the paper web is continuous also in the region of the thin sites 34 such that the outline form formed by them does not shift upon removal of the still wet paper web from the cylinder mold 22.

After sheet formation, the paper web 32 is dewatered in the press section. During this process, perpendicular to the paper web expanse (arrow 36), forces act that separate from the still wet paper web the inner region delimited by the thin sites 34 that act as predetermined breaking points. A through opening 12 is created having characteristic edge irregularities 38 (FIG. 6) whose shape is determined by the outline contour formed by the thin sites 34 and thus by the shape of the metal forming parts 28.

In this way, the contour of the opening 12 is reproducibly produced in the onward traveling paper web without being negatively impacted by variations in the sheet formation and the inherent flexibility of the wet fiber stock.

In the exemplary embodiment in FIG. 3, the metal forming parts 28 exhibit a line width of 2 mm and a height of 1 mm. It is understood that, depending on the desired irregularity of the edge curve, the size of the motif or the properties of the paper pulp, also other values may be used for the line width or the forming part height. The forming parts 28 can also be produced, rather than from metal, from a hard plastic, or they can be formed by a sealing compound that is applied to the mold in the viscous state and subsequently cured.

The invention claimed is:

1. A method for manufacturing a security paper, for security or value documents, that exhibits at least one through opening having characteristic irregularities in the edge region, characterized in that on a paper mold, a paper web is formed having sites, thinner than the other parts of the web, said sites being in the form of the outline of the desired shape of the at least one through opening, and after sheet formation, the paper web is dewatered, an inner region delimited by the sites being separated from the paper web by the occurring forces, and after the dewatering step, the inner region is removed from the paper web.

2. The method according to claim 1, characterized in that the paper web is formed on a paper mold having applied line-shaped forming elements that, during sheet formation, lead to the development of the sites in the paper web.

3. The method according to claim 2, characterized in that the line-shaped forming elements form a substantially closed curve.

4. The method according to claim 3, characterized in that the forming elements are formed by line-shaped metal or plastic forming parts applied to the paper mold.

5. The method according to claim 3, characterized in that the forming elements are formed by a line-shaped sealing compound that is firmly bonded with the paper mold.

6. The method according to claim 3, characterized in that, at sheet formation, the sites are produced having fewer fibers than other parts of the paper web.

7. The method according to claim 3, characterized in that at least one through opening is produced having an outline in the shape of a graphic motif.

8. The method according to claim 3, characterized in that the at least one through opening is closed on one or on both sides of the security paper with a foil element.

9. The method according to claim 3, wherein the line-shaped forming elements exhibit a line width between 0.3 mm and 5 mm and a height between 0.5 mm and 2 mm.

10. The method according to claim 2, characterized in that the forming elements are formed by line-shaped metal or plastic forming parts applied to the paper mold.

11. The method according to claim 2, characterized in that the forming elements are formed by a line-shaped sealing compound that is firmly bonded with the paper mold.

12. The method according to claim 2, characterized in that, at sheet formation, the sites are produced having fewer fibers than other parts of the paper web.

13. The method according to claim 2, characterized in that the at least one through opening is produced having an outline in the shape of a graphic motif.

14. The method according to claim 2, characterized in that the at least one through opening is closed on one or on both sides of the security paper with a foil element.

15. The method according to claim 2, wherein the line-shaped forming elements exhibit a line width between 0.3 mm and 5 mm and a height between 0.5 mm and 2 mm.

16. The method according to claim 1, characterized in that, at sheet formation, the sites are produced having fewer fibers than other parts of the paper web.

17. The method according to claim 1, characterized in that at least one through opening is produced having an outline in the shape of a graphic motif.

18. The method according to claim 1, characterized in that the at least one through opening is closed on one or on both sides of the security paper with a foil element.

* * * * *